US009386671B2

(12) United States Patent
Kluetz et al.

(10) Patent No.: US 9,386,671 B2
(45) Date of Patent: Jul. 5, 2016

(54) METHOD AND CONTROL CIRCUIT FOR STARTING A GAS-DISCHARGE LAMP

(75) Inventors: Peter Kluetz, Reutlingen (DE); Ruediger Laubenstein, Reutlingen (DE); Christian Johann, Reutlingen (DE); Bjoern Moosmann, Dettingen (DE); Michael Herrmann, Reutlingen (DE); Matthias Roder, Reutlingen (DE)

(73) Assignee: Automotive Lighting Reutlingen GmbH, Reutlingen (DE)

( * ) Notice: Subject to any disclaimer, the term of this patent is extended or adjusted under 35 U.S.C. 154(b) by 419 days.

(21) Appl. No.: 13/641,522

(22) PCT Filed: Apr. 13, 2011

(86) PCT No.: PCT/EP2011/055831

§ 371 (c)(1), (2), (4) Date: Dec. 10, 2012

(87) PCT Pub. No.: WO2011/134796

PCT Pub. Date: Nov. 3, 2011

(65) Prior Publication Data

US 2013/0214694 A1 Aug. 22, 2013

(30) Foreign Application Priority Data

Apr. 27, 2010 (DE) ..... 10 2010 018 325

(51) Int. Cl.

*H05B 41/04* (2006.01)
*H05B 41/288* (2006.01)
*H05B 41/38* (2006.01)

(52) U.S. Cl.

CPC ..... *H05B 41/04* (2013.01); *H05B 41/2881* (2013.01); *H05B 41/388* (2013.01)

(58) Field of Classification Search

None

See application file for complete search history.

(56) References Cited

U.S. PATENT DOCUMENTS

| | | | | |
|---|---|---|---|---|
| 4,350,930 | A | 9/1982 | Peil et al. | |
| 8,482,213 | B1 * | 7/2013 | Xiong et al. | 315/224 |
| 8,878,446 | B2 * | 11/2014 | Laubenstein | 315/209 R |
| 2010/0194303 | A1 * | 8/2010 | Komatsu | 315/224 |

(Continued)

FOREIGN PATENT DOCUMENTS

| | | | |
|---|---|---|---|
| CN | 1159681 | A | 9/1997 |
| JP | 2002075673 | A | 3/2002 |

(Continued)

OTHER PUBLICATIONS

Mar. 9, 2012 International Search Report and Written Opionion (PCT/EP2011/055831).

(Continued)

*Primary Examiner* — Lincoln Donovan
*Assistant Examiner* — Khareem E Almo
(74) *Attorney, Agent, or Firm* — Howard & Howard Attorneys PLLC

(57) ABSTRACT

A method operates a gas-discharge lamp (16) in a transition from a "deactivated" state without an electric arc to a stable "light-generating" state. The method comprises steps of discharging a booster capacitor (C2) in an "acquisition" phase following an ignition-voltage impulse via a current path that conducts a current flowing through the gas-discharge lamp (16) and in which an inductor (L1) having at least one switch (S5) lies in series and cyclically discharging the booster capacitor (C2) by a repeated alternating closing and opening of the switch (S5).

12 Claims, 2 Drawing Sheets

(56) References Cited

U.S. PATENT DOCUMENTS

| | | | | |
|---|---|---|---|---|
| 2010/0244716 | A1* | 9/2010 | Yamahara et al. | 315/224 |
| 2011/0254452 | A1* | 10/2011 | Kunzmann et al. | 315/135 |
| 2013/0214694 | A1* | 8/2013 | Kluetz et al. | 315/224 |

FOREIGN PATENT DOCUMENTS

| | | | |
|---|---|---|---|
| JP | 2008277083 | A | 11/2008 |
| WO | 03/077614 | A1 | 9/2003 |
| WO | 2008/123274 | A1 | 10/2008 |

OTHER PUBLICATIONS

Notice of Reasons for Rejection, in co-pending Japanese Application No. 2013-506576.

* cited by examiner

METHOD AND CONTROL CIRCUIT FOR STARTING A GAS-DISCHARGE LAMP

CROSS-REFERENCE TO RELATED APPLICATIONS

This is a "national stage" application of International Patent Application PCT/EP2011/055831 filed on Apr. 13, 2011, which, in turn, claims priority to and benefit of the filing date of German Patent Application 10 2010 018 325.3 filed on Apr. 27, 2010.

BACKGROUND OF INVENTION

1. Field of Invention

The invention relates to a method and control circuit for, in general, starting a gas-discharge lamp and, in particular, operating the lamp in a transition from a "deactivated" state without an electric arc to a stable "light-generating" state.

2. Description of Related Art

A method for operating a gas-discharge lamp in a transition from a "deactivated" state without an electric arc to a stable "light-generating" state and a corresponding control circuit are known per se. With the operation of a gas-discharge lamp—in particular, one to be used in gas-discharge lamps of lighting apparatuses designed for motor vehicles used on roads—an electric arc between two electrodes is generated in a glass bulb filled with gas. In the transition from the "inactive" state without an electric arc to a stable "light-generating" state, numerous phases can be distinguished—designated as the "ignition," "acquisition," and "start-up." At this point, the normal operating state with a stably burning electric arc follows.

For the ignition, first, an ignition-voltage impulse is applied to the electrodes. The ignition-voltage impulse is very short and leads to an ionization of gas particles in the electric field between the electrodes. The extent of the impulse-like ignition voltage for typical commercial gas-discharge lamps for motor vehicle headlamps is between 20 kV and 30 kV.

In a phase designated as the "acquisition" energy stored in a booster capacitor is used to subsequently accelerate the ionized gas particles to the extent that, by impact ionization, snowballing charge breakdown is established between the electrodes, which ignites the electric arc, and the arc is sustained.

In doing so, the voltage of the booster capacitor (previously charged to about 400 V) decreases to a lamp voltage that can be adjusted for stable operation. For lamps containing Hg, this is about 80 V. Lamps not containing Hg are operated with a lamp voltage of 43 V. It is generally accepted that the lamp voltage can be between 30 V and 120 V, depending on the design of the lamp. The "acquisition" phase lasts, for example, for a few hundred microseconds.

Following the acquisition, the starting-up of the gas-discharge lamp occurs with a temporary "direct current" operation, which serves to heat the electrodes quickly. A typical duration, of a "direct current" operation lasts for 50 milliseconds. Normally, a second "direct current" phase of the same length follows a first "direct current" phase and has a reversed polarity.

Subsequently, the gas-discharge lamp is operated in the normal operating state with an alternating current having a frequency of 250 Hz to 800 Hz—in particular, at about 400 Hz—and a value for the lamp voltage between the two electrodes dependent on the design of the lamp, which lies between 30 V and 120 V. The operation with alternating current serves to establish a limiting of a loss of contact material in the electrode.

In this context, the invention concerns the discharge of the booster capacitor in the phase designated as the "acquisition" with which the energy is made available for the snowballing breakdown resulting from a charge acceleration and impact ionization. The term "acquisition" indicates the transition to the electric arc.

The acquisition behavior of gas-discharge lamps depends on, among other things, the quantity of energy made available during the "acquisition" phase. For a reliably reproducible acquisition (i.e., reliably resulting buildup of the electric arc), it is necessary that the time period of the current flow of the discharge current from the booster capacitor exceeds a predetermined minimum value and the current of the discharge current neither falls below a predetermined minimum value during this time period nor exceeds a predetermined maximum value.

The limiting to a maximum value serves to protect the gas-discharge lamp and circuit components conducting the discharge current from an unacceptable high current load. Not falling below the minimum value and time period, on the other hand, is necessary for preventing an extinguishing of the electric arc after the discharging of the booster capacitor.

In the transition from the "non-activated" state (without an electric arc) to a state of the gas-discharge lamp in which a stable light is generated, the booster capacitor is discharged by a current pathway in the "acquisition" phase following the ignition-voltage impulse that flows through the current flowing through the gas-discharge lamp and in which an inductor having at least one circuit is disposed in series. With the related art, the inductor is formed from the secondary inductor of an ignition transformer that provides the ignition impulse, and the discharge current flows through a discharge resistor connected in series to the booster capacitor. The booster capacitor serves, thereby, as an energy source in a series connection arising from the discharge resistor and gas-discharge lamp. The discharge resistor increases, thereby, the resistance in the discharge-current circuit, which increases the discharge time period and reduces the extent of the discharge current.

With a circuit of this type, the energy stored in the booster capacitor is distributed during the discharge in relation to the impedances from the discharge resistor and gas-discharge lamp to the discharge resistor and gas-discharge lamp. The portion of energy for the discharge resistor is transformed to heat therein and is, thereby, made unavailable for the build-up and sustaining of the electric arc. With a cold start of the gas-discharge lamp, the energy portion has a lower value in comparison with the discharge resistor such that the major portion of the stored energy in the discharge resistor is converted to heat such that it serves no purpose.

A suitable dimensioning of the discharge resistor is characterized as being technically and economically difficult primarily by an increased ambient temperature of the resistors from 150° C.

Thus, there is a need in the related art for a method and control circuit of the respective types specified above that ensure that the gas-discharge lamp (independently of its state—in particular, its type, age, manufacturer, and variability of characteristics due to manufacturing conditions) is provided with the energy necessary for a successful acquisition, whereby the specified technical and economical difficulties associated with the dimensioning of one or more discharge resistors do not occur.

SUMMARY OF INVENTION

The invention overcomes disadvantages in the related art in a method for operating a gas-discharge lamp in a transition from a "deactivated" state without an electric arc to a stable "light-generating" state. The method comprises steps of discharging a booster capacitor in an "acquisition" phase following an ignition-voltage impulse via a current path that conducts a current flowing through the gas-discharge lamp and in which an inductor having at least one switch lies in series and cyclically discharging the booster capacitor by a repeated alternating closing and opening of the switch.

The invention overcomes disadvantages in the related art in also a control circuit equipped for operation of a gas-discharge lamp in a transition from a "deactivated" state without an electric arc to a stable "light-generating" state. The control circuit comprises a booster capacitor that is adapted to be discharged in an "acquisition" phase following an ignition-voltage impulse via a current path that conducts a current flowing through the gas-discharge lamp and in which an inductor having at least one switch lies in series and cyclically discharged by a repeated alternating closing and opening of the switch.

In the "method" aspects, the invention provides that the booster capacitor is discharged cyclically by a repeated alternating closing and opening of the switch. In the "device" aspects, the invention provides that the control circuit is designed to be able to discharge the booster capacitor cyclically by a repeated alternating closing and opening of the switch.

In this manner, a resulting alternation between increasing and decreasing values of the discharge current occurs in the cycle of the switch control. As a result of the alternation, a desired average discharge current can be set that lies below a predetermined "threshold" value. In differing from the discharge resistor of the related art, the inductor does not irreversibly convert the occurring portion of the energy stored in the booster capacitor to heat (but, rather, in a reversible manner, to magnetic-field energy that is used during the opening of the switch for maintaining the current flow through the gas-discharge lamp even when the switch is open. As a result, the current flow through the lamp when the switch is open only sounds as if it is delayed.

The result is the advantage that a largest possible portion of the energy stored in the booster capacitor is available for the acquisition (i.e., energy is available for the releasing of a snowballing breakdown and generation of a stable electric arc between the electrodes of the gas-discharge lamp). In other words, by the invention, a larger portion of the energy stored in the booster capacitor is transferred to the gas-discharge lamp than with the related art.

The structural components involved are exposed to a lower thermal lead in comparison with the discharge resistors of the related art and can be dimensioned for a lower current-load capacity and, thereby, made in smaller sizes and less expensively.

The booster capacitor can also be reduced in size due to the better utilization of energy. Instead of the film capacitors used in the related art, other types of capacitors—such as electrolyte or ceramic-layer capacitors—can also be used. One disadvantage of ceramic capacitors is that, with high voltages, they display less than 40% of their capacity at low voltage values. Through the greater efficiency of the cyclical discharge, this can be compensated for.

Furthermore, the discharge current increases directly after the ignition more quickly than with the related art. This has a positive effect on the acquisition performance. The significantly higher average acquisition current during a hot ignition has a positive effect on the hot-ignition performance. The possibility for influencing the temporal course of the acquisition current by changing the cyclical frequency and/or its duty cycle also presents an advantage.

The temporal control of the cyclical booster discharge is basically possible without extensive additional circuitry by a temporally controlled pulse relay.

Other objects, features, and advantages of the invention are readily appreciated as it becomes more understood while the subsequent detailed description of at least one embodiment of the invention is read taken in conjunction with the accompanying drawing thereof.

BRIEF DESCRIPTION OF EACH FIGURE OF DRAWING OF INVENTION

DETAILED DESCRIPTION OF EMBODIMENTS OF INVENTION

Figure 1:
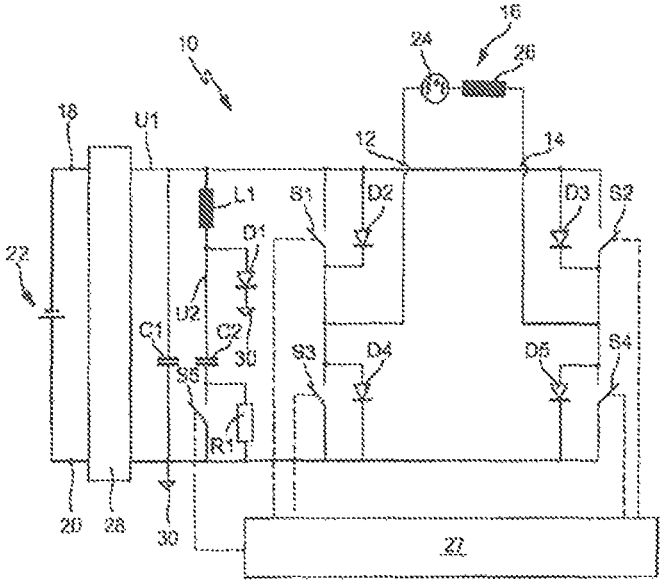
FIG. 1 illustrates a first embodiment of a control circuit according to the invention.

In detail, FIG. 1 shows a control circuit 10 connected by circuit points 12, 14 to a gas-discharge lamp 16 and circuit points 18, 20 to an electric-power source 22. The gas-discharge lamp 16 is designed for a motor-vehicle lighting device—in particular, a lamp of the type D1, D3, or D5 having an integrated ignition device. The invention can, however, also be used with lamps of the type D2, D4, or D6 having external ignition devices. The electric-power source 22 is a power or current source in the electric wiring system of the motor vehicle (e.g., a motor-vehicle battery).

In the embodiment, the gas-discharge lamp 16 has a lamp 24 (i.e., glass bulb filled with gas) having two electrodes and an integrated ignition device of which FIG. 1 shows a secondary inductor 26 of an ignition transformer. The secondary inductor 26 is connected in series in the current path between the circuit points 12, 14 and equipped to generate an ignition-voltage impulse of numerous kilovolts—in particular, 20 kV to 30 kV—as a reaction to a corresponding excitation by a magnetic field of a primary coil of the ignition transformer (not shown).

The current flow through the lamp 24 is controlled by a control module 27 of the control circuit 10 that closes, for this purpose, various current paths running through the switches S1-S5. A "DC/DC" converter charges the capacitors C1, C2 prior to an activation of the gas-discharge lamp 16 to a first value of a voltage U1 and makes available a stable value of the voltage U1 for a stably burning electric arc of the gas-discharge lamp 16.

The control module 27 is equipped to be able to control the course of the method according to the invention or one of its embodiments. In one embodiment, the control module 27 is an integrated electric circuit having computing and storage capacities programmed for controlling a method of this type.

In an embodiment, the first value is about 400 V. The second value—the lamp voltage (depending on the design of the lamp)—is between 30 V and 120 V. In this embodiment, the voltage U1 with respect to the ground 30 is negative. The principle of the depicted circuit can also, however, be used, with positive voltages U1. In this case, however, the free-wheeling diodes D1, D2, D3, D4, D5 are to be connected in the reverse direction. The capacitor C2 is the booster capacitor. The capacitor C1 is a smoothing capacitor.

The resistor R1 is a charging resistor for the booster capacitor C2 and bypassed when the switch S5 is closed. For this reason, it does not carry the discharge current and, thus, is not comparable with the discharge resistor from the related art, which conducts the discharge current therein, and, thereby, converts the energy stored in the booster capacitor C2 to heat.

With respect to its function, limiting the discharge current and, thereby, temporally extending the time period of the discharge, the discharge resistor in the embodiment depicted in FIG. 1 of a control circuit 10 is replaced by the inductor L1 together with the switch S5 lying in series with the inductor L1 in the discharge current path as well as a control module 27 that cyclically opens and closes the switch S5.

In the following, the performance of the control circuit 10 shall be described with respect to the "acquisition" phase. The switches S5, S1, S4 are closed in a first method step prior to the ignition. The switches S2, S3 are open.

At the converter output, there is first a voltage of about 400 V. U1 is negative with respect to the reference potential indicated by the triangle 30. The booster capacitor C2 is charged to this voltage. No current flows through the inductor L1.

As a result of a short high-voltage ignition-impulse, the gas-discharge lamp 16 is capable of conducting a current between its two electrodes. As a result of the current flow, the voltage U1 breaks down. The U1-side upper end of the inductor L1 is positive with respect to the C2-side lower end such that it establishes a voltage via the inductor L1. The voltage drives a current through the inductor L1, which is fed from the booster capacitor C2. The charge and, thereby, stored energy of the booster capacitor C2 is reduced. The energy loss of the booster capacitor C2 is distributed to the gas-discharge lamp 16 and magnetic field of the inductor L1.

In differing from the related art, wherein the portion of energy not flowing into the gas-discharge lamp is irreversibly converted to heat in the ohmic-discharge resistor, in this case, a reversible storage of energy in a magnetic field of the inductor L1 occurs.

Before the current level of the discharge current is able to increase to a critical value, a switch in the discharge circuit—for example, the switch S5—is reopened in an additional method step. The magnetic field of the inductor L1 then breaks down, which leads, by the inductance, to the current flow only returning in a delayed manner through the inductor L1, wherein the current flows-off to the reference potential via the free-wheeling diode D1 when the switch S5 is open. As soon as the returning discharge-current level has fallen off sufficiently, the switch S5 is again closed in another method step. The discharge current again increases, a magnetic field is built up, and so on. As a result, a cyclical discharge of the booster capacitor C2 occurs in which the larger portion of the capacitive stored energy can be used within the "acquisition" phase for the generation and stabilization of the electric arc in the lamp 24.

By this method and the selection of an appropriate "on" and "off" switching time of the switch S5, the acquisition current flowing through the lamp can be freely set within the given limits such that a predetermined maximum value is not exceeded and the current does not fall below a minimum value dependent on the time range, which is necessary for sustaining the electric arc.

This basic principle may be used for positive as well as negative values of the output voltage U1 of the "DC/DC" converter. The control circuit 10 is equipped for negative values from U1. For positive values from U1, the free-wheeling diodes D1, D2, D3, D4, D5 must be incorporated with the polarity reversed.

Figure 2:
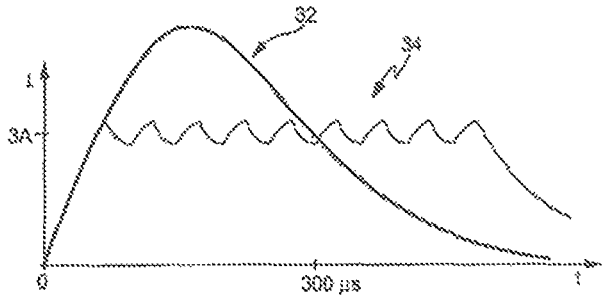
FIG. 2 illustrates a course of discharge current of a booster capacitor with circuits according to the related art and invention for purpose of clarification of an embodiment of a method according to the invention.

FIG. 2 shows (in a qualitative form) a course 32 of the discharge current over time for the related art in comparison, with a course 34 that would be obtained by a control circuit according to the invention in connection with the method according to the invention. In the coarse 32, the discharge current increases first to (in principle) an unfavorably high maximum value to subsequently fall-off in a comparably fast manner.

In the course 34, the increase (which, in deviating from the depiction in FIG. 2 also is steeper at first and, therefore, can occur more quickly than the increase 32), in contrast, is interrupted at a lower value than the maximum value of the course 32 by the opening of a switch lying in series with the inductor L1 in the discharge-current path. Subsequently, this switch is cyclically opened and closed again such that (in a qualitative manner) the illustrated current profile 34 results with which an average current level is maintained over a comparably longer time period than with the course 32. For a reliable acquisition performance, it is favorable that the average current level is maintained for at least about 300 μs, and, thereby, a discharge current flows at about 3 A. From a comparison of the curves 32, 34, one sees that these requirements are better fulfilled by the current profile 34 than by the current profile 32. Furthermore, in the course 34, the unfavorably high starting maximum value of the course 32 is not present, which starting maximum value results in a high thermal load to a discharge resistor and other components in the discharge current path, including the gas-discharge lamp 16 itself.

The start-up of the gas-discharge lamp follows the discharge of the "acquisition" phase connected to the booster capacitor C2 with a temporary "direct current" operation. A typical length of a "direct current" phase is 50 ms. A first "direct current" phase is normally followed by a second "direct current" phase of the same length with reversed polarity. Subsequently, the gas-discharge lamp is operated in the normal operating state with an alternating-current voltage having a frequency of 250 Hz to 800 Hz—in particular, at about 400 Hz—and a lamp voltage between the two electrodes that, depending on the design of the lamp, lies between 30 V and 120 V. For this, an alternating switching occurs between a current flow (occurring via the switches S4, S1) and an alternative current flow (occurring via the switches S3, S2 of the H-bridge from the switches S1, S2, S3, S4). The switching occurs by the control module 27, which accordingly opens and closes the switches. The switches S1-S5 are, in an embodiment, transistors. The operation with alternating-current voltage serves for a limiting of loss of contact material in the electrodes. This applies analogously to the subject matter of FIG. 3.

Figure 3:
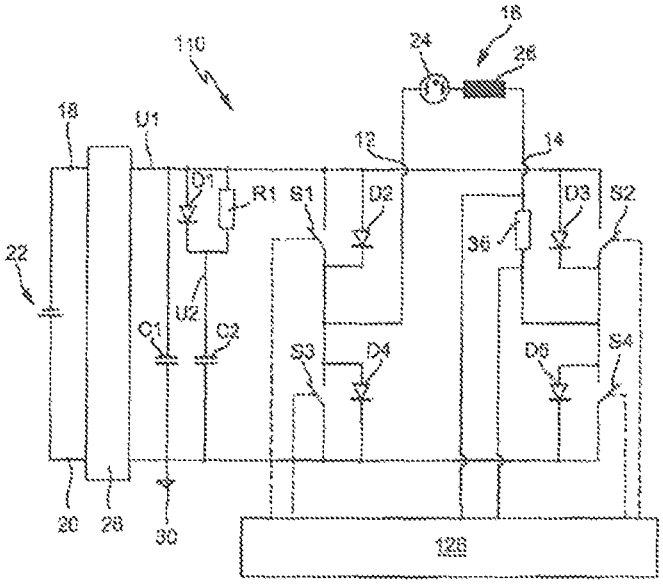
FIG. 3 illustrates a second embodiment of the control circuit according to the invention.

FIG. 3 shows a control circuit 110 as a second embodiment of a control circuit according to the invention. The control circuit 110 differs from the control circuit 10 of FIG. 1 in that the control circuit 110 functions without a separate inductor L1 and separate switch S5 for the cyclical discharge of the booster capacitor C2. Instead of the inductor L1 of the control circuit 10 in FIG. 1, in this case, the secondary inductor 20 of the ignition transformer as well as at least one of the switches S1, S2, S3, S4 forming the H-bridge serve for the cyclical discharge of the booster capacitor C2. In the "acquisition" phase, the circuit 110 functions in the manner described below.

The switches S1, S4 are closed for the ignition. The switches S2, S3 are open. After the ignition of the lamp in the gas-discharge lamp 16, the built-up voltage U1 of the "DC/

DC" converter 28 breaks down due to the current flow through the lamp 24 caused by the electric arc. This leads to a voltage difference through the decoupling diode D1, which starts to conduct. For all practical purposes, the parallel circuitry from the smoothing capacitor C1, booster capacitor C2, and, therefore, the entire output voltage U1 via the H-bridge is directly applied to the ignition portion. This causes an increase in the current over time through the lamp 24 and secondary inductor 26 of the ignition transformer. When a limit current has been reached, either both current-conducting switches S1, S4 or (to ensure an override and prevent an electrical surge at the C1-side output of the "DC/DC" converter 28) only the lower current-conducting switch S4 are/is opened. As a result, a current can no longer flow through the H-bridge.

In the following, the case shall first be examined in which the two current-conducting H-bridge switches S4, S1 are open. The secondary inductor 26 then drives the current farther through the free-wheeling diode D3 of the upper, open H-bridge switch S2 on the smoothing capacitor C1. The current through the secondary inductor 26 falls off until the switches S1, S4 are again activated. A voltage surge may occur at the smoothing capacitor C1.

As an alternative, the case shall be examined in which only the potential-wise upper current-conducting H-bridge switch S4 is open and the potential-wise lower switch S1 remains closed. In this case, the secondary inductor 26 then drives the current farther through the free-wheeling diode D3 of the potential-wise lower, open H-bridge switch S2, and the closed potential-wise lower H-bridge switch S1 again drives the current through the gas-discharge lamp 16. In this case, there is no voltage surge to the smoothing capacitor 1 because the circuit is closed. The current through the gas-discharge lamp 16 begins to decrease. After a certain time, the previously open switch S4 of the H-bridge is again closed. The current through the gas-discharge lamp 16 and, therefore, both through the lamp 24 as well as the secondary inductor 26 again begins to increase.

Another embodiment provides that only the potential-wise lower current-conducting H-bridge switch S1 is opened. In this case, the secondary inductor 26 drives the current farther through the free-wheeling diode D4 of the potential-wise upper, open H-bridge switch S3 and closed potential-wise upper H-bridge switch S4 farther through the gas-discharge lamp 16. There is no voltage surge to the smoothing capacitor C1 because the circuit is closed. The current through the inductor 26 or lamp 24 begins to fall off. After a certain time, the previously open switch S1 of the H-bridge is again closed. The current through the lamp 24 and secondary inductor 26 again begins to increase.

For each of these three embodiments, it is the case that the acquisition current flowing through the gas-discharge lamp 16 can be freely set within the predetermined limits by the selection of an appropriate "on" and "off" switching time of the switch S4 or switches S1, S4. As a result, the maximum value is not exceeded, and the current does not fall below the time-range-dependent minimum value necessary for sustaining the electric arc. A time control of this type is obtained by a corresponding programming or circuit-wise implementation of the control circuit that is used. This applies independently of the specific embodiment depicted in FIG. 1.

With the control circuit 110, which uses the secondary inductor 26 of the ignition circuit, the separate inductor L1 and switch S5 used in the control circuit 10 can be eliminated. The basic principle of the control circuits 10, 110 may be used for both positive as well as negative output voltages U1 of the "DC/DC" converter 28. With the depicted connection direction of the diodes D1-D5, the control circuit 126 is equipped for negative values of the output voltage U1 of the "DC/DC" converter 28 with respect to the ground 30. For positive values of U1, the decoupling diode D1 and free-wheeling diodes D2, D3, D4, D5 are to be connected with reversed flow and reverse biasing.

Apart from this, the control circuit 110 functions according to the same basic principle of the cyclical discharge in connection with an inductive-energy storage as that of the control circuit 10. In this regard, the design of the embodiments of the control module 26 in FIG. 1 also applies to the control module 126 in FIG. 3.

One embodiment of the method provides that the current level of the discharge current is measured and the at least one switch is then opened if the current level exceeds a predetermined first threshold value and closed if the current level falls below a predetermined second threshold value.

For this, the first threshold value in an embodiment is determined as the sum of a predetermined reference value and portion of a predetermined fluctuation range, and the second threshold value is determined as the difference of the reference value and a predetermined second threshold value.

In this manner, a hysteresis behavior is generated. For a control via a hysteresis regulator, the acquisition current through the lamp is recorded by a measurement device and compared to a reference signal. The measurement device is implemented in FIG. 3 by a measurement resistor 36 in connection with an evaluation of the voltage by the measurement resistor 36 in the control module 126. Analogously, another embodiment provides that the circuit according to FIG. 1 has a measurement resistor 36 of this type in connection with a control module 27 equipped for voltage measurement.

The switch S5 in the control circuit 10 from FIG. 1, switch S4, or switches S1, S4 in the control circuit 110 in FIG. 3 is/arc switched "off" when the sum of the reference value and a portion (e.g., one half) of the hysteresis has been reached. If the value falls below the reference value minus the portion of the hysteresis, the switch or switches is/are again activated. The result is an average current flow that is proportional to the reference value. The reference value can also be determined dependent on other parameters (such as the output voltage U1 of the "DC/DC" converter 28 and/or residual voltage U2 of the booster capacitor C2), or it may be controlled in an arbitrary manner by a suitable control software. In this manner, it is possible to ensure a sufficient current flow through the gas-discharge lamp 16 over the course of a longer time period.

Another embodiment provides that the at least one switch, using a frequency and fixed duty cycle, is opened and closed. In this alternative to the "hysteresis" regulation, the switch S5 in the control circuit 10, switch S4, or switches S1, S4 in the control circuit 110 is/are controlled with a suitable fixed frequency and suitable fixed duty cycle. By a suitable selection of the duty cycle and frequency, the current through the gas-discharge lamp 16 is limited to the maximum acceptable value.

By the voltage U1 breaking-down during the acquisition, the activated current automatically decreases with a fixed duty cycle and fixed frequency, resulting in a temporally decreasing acquisition current through the gas-discharge lamp 16. In this manner, it is also possible to ensure a sufficient current flow through the gas-discharge lamp 16 over the course of a longer time period.

An alternative embodiment provides for a control with a variable frequency and/or variable duty cycle. With this embodiment, the switch S5 in the control circuit 10, switch S4, or switches S1, S4 in the control circuit 110 is/are controlled with a variable frequency and/or suitable variable duty cycle. The suitable control of the duty cycle and/or frequency makes it possible to influence in an arbitrary manner the acquisition current over the course of time. In this manner, it is also possible to ensure a sufficient current flow through the gas-discharge lamp over a longer time period.

In comparison with a control using a fixed frequency and fixed duty cycle, with variable-control frequencies and/or variable duty cycles, a greater degree of freedom in the temporal course of the acquisition current is obtained. In contrast to control with a fixed frequency and fixed duty cycle, for example, it is also possible to regulate a constant value of the discharge current to a temporal average.

The invention has been described above in an illustrative manner. It is to be understood that the terminology that has been used above is intended to be in the nature of words of description rather than of limitation. Many modifications and variations of the invention are possible in light of the above teachings. Therefore, within the scope of the appended claims, the invention may be practiced other than as specifically described above.

What is claimed is:

1. A method for operating a gas-discharge lamp (16) in a transition from a "deactivated" state without an electric arc to a stable "light-generating" state, the method comprising steps of:

discharging a booster capacitor (C2) in an "acquisition" phase following an ignition-voltage impulse via a discharge current path that conducts a current flowing from the gas-discharge lamp (16) through a circuit branch comprising an inductor (L1), the booster capacitor (C2) and at least one switch (S5) disposed in series with one another; and cyclically discharging the booster capacitor (C2) by a repeated alternating closing and opening of the switch (S5), wherein a level of discharge current is measured and the switch (S5) is then opened if the level exceeds a predetermined first "threshold" value and is closed if the level falls below a predetermined second "threshold" value.

2. The method as set forth in claim 1, wherein the at least one switch (S5) is closed and opened for cyclical discharge in a temporally controlled manner.

3. The method as set forth in claim 2, wherein, for the cyclical discharge, at least one current-conducting switch of an H-bridge is activated synchronously.

4. The method as set forth in claim 3, wherein, for the cyclical discharge, only a potential-wise upper-current conducting switch of the H-bridge switch is activated.

5. The method as set forth in claim 3, wherein, for the cyclical discharge, only a potential-wise lower-current-conducting switch of the H-bridge switch is activated.

6. The method as set forth in claim 1, wherein the first "threshold" value is determined as a sum of a predetermined "reference" value and the second "threshold" value is determined as a difference of the "reference" value and a predetermined second "threshold" value.

7. The method as set forth in claim 6, wherein the "reference" value is predetermined in dependence on either of an output voltage of at least one "DC/DC" converter (28) charging the booster capacitor (C2) and a residual voltage (U2) via the booster capacitor (C2).

8. The method as set forth in claim 1, wherein the switch (S5) is opened and closed with at least one of a fixed frequency and fixed duty cycle.

9. The method as set forth in claim 1, wherein the switch (S5) is opened and closed with at least one of a variable frequency and variable duty cycle.

10. A control circuit (10) equipped for operation of a gas-discharge lamp (16) in a transition from a "deactivated" state without an electric arc to a stable "light-generating" state, the control circuit comprising:

a booster capacitor (C2) that is adapted to be discharged in an "acquisition" phase following an ignition-voltage impulse via a discharge current path that conducts a current flowing from the gas-discharge lamp (16) through a circuit branch comprising an inductor (L1), the booster capacitor (C2) and at least one switch (S5) disposed in series with one another, said booster capacitor being cyclically discharged by a repeated alternating closing and opening of the switch (S5), wherein the control circuit is adapted to measure a level of a discharge current and to open the switch (S5) if the level exceeds a predetermined first "threshold" value and to close said switch if the level falls below a predetermined second "threshold" value.

11. The control circuit (10) as set forth in claim 10, wherein the control circuit (10) comprises further a "DC/DC" converter (28) and the inductor (L1) is connected in series with the booster capacitor (C2) and switch (S5) between two output terminals of the "DC/DC" converter (28) and in parallel to a series connection including at least one switch (S4) and the gas-discharge lamp (16).

12. The control circuit (10) as set forth in claim 10, wherein the control circuit (10) comprises further a "DC/DC" converter (28) and an inductor (26) is connected in series to the gas-discharge lamp (16) and in parallel to a series connection including the booster capacitor (C2) and a charging resistor (R1) of the booster capacitor (C2).

* * * * *